US005483329A

United States Patent [19]

Asanae et al.

[11] Patent Number: 5,483,329

[45] Date of Patent: Jan. 9, 1996

[54] CARRIER FOR DEVELOPER AND METHOD OF ELECTROPHOTOGRAPHICALLY FORMING VISUAL IMAGE USING SAME

[75] Inventors: Masumi Asanae; Tsutomu Saitoh, both of Kumagaya, Japan

[73] Assignee: Hitachi Metals, Ltd., Tokyo, Japan

[21] Appl. No.: 292,957

[22] Filed: Aug. 22, 1994

[30] Foreign Application Priority Data

Aug. 24, 1993 [JP] Japan ..... 5-209073

[51] Int. Cl.[6] ..... G03G 15/06; G03G 15/24

[52] U.S. Cl. ..... 355/269; 355/251; 430/106.6; 430/111

[58] Field of Search ..... 355/251, 253, 355/245, 269, 270; 430/106.6, 108, 111; 118/653, 656–658

[56] References Cited

U.S. PATENT DOCUMENTS

| | | | |
|---|---|---|---|
| 3,278,439 | 10/1966 | Blanchette et al. . | |
| 3,847,604 | 11/1974 | Hagenbach et al. . | |
| 4,478,925 | 10/1984 | Miskinis | 430/108 X |
| 4,486,502 | 12/1984 | Hara et al. | 430/106.6 X |
| 4,503,136 | 3/1985 | Hara et al. | 430/106.6 |
| 4,517,274 | 5/1985 | Honda et al. | 430/122 |
| 4,535,047 | 8/1985 | Colby, Jr. | 430/108 |
| 4,640,880 | 2/1987 | Kawanishi et al. | 430/106.6 |
| 5,075,729 | 12/1991 | Hayashi et al. | 355/269 |
| 5,196,891 | 3/1993 | Shimazaki et al. | 355/269 |
| 5,358,818 | 10/1994 | Wilson et al. | 430/106.6 |

FOREIGN PATENT DOCUMENTS

| | | |
|---|---|---|
| 0154433 | 9/1985 | European Pat. Off. . |
| 0492665 | 7/1992 | European Pat. Off. . |
| 0576893 | 1/1994 | European Pat. Off. . |
| 2308131 | 11/1976 | France . |
| 2007003 | 8/1970 | Germany . |
| 52-105829 | 9/1977 | Japan . |
| 59-26742 | 2/1984 | Japan . |
| 59-38755 | 3/1984 | Japan . |
| 59-94763 | 5/1984 | Japan . |
| 1-21503 | 4/1989 | Japan . |
| 4-86878 | 3/1992 | Japan . |
| 2149525 | 6/1985 | United Kingdom . |

OTHER PUBLICATIONS

European Search Report.

*Primary Examiner*—William J. Royer
*Attorney, Agent, or Firm*—Finnegan, Henderson, Farabow, Garrett & Dunner

[57] ABSTRACT

There is provided an improved carrier for a developer for use in an electrophotographic recording apparatus, which is composed of iron particles having non-spherical shapes and an average size of 10–50 μm, and resin layers formed on surfaces of the iron particles. There is also provided a method of producing a visual toner image, in which a developer containing the above carrier is employed and a magnetic brush of the developer functions to develop an electrostatic latent image and clean a residual toner simultaneously. The toner image obtained exhibits a high toner density and a high image quality.

8 Claims, 2 Drawing Sheets

CARRIER FOR DEVELOPER AND METHOD OF ELECTROPHOTOGRAPHICALLY FORMING VISUAL IMAGE USING SAME

BACKGROUND OF THE INVENTION

The present invention relates to a carrier for a developer and a method of electrophotographically producing a visual toner image by using the developer containing such a carrier. More particularly, the present invention relates to an improved carrier serving as a constituent of a developer and having particular shape and size, and a method of electrophotographically forming a visual toner image using the developer containing such a carrier, thereby obtaining a toner image with a high density and a high quality and achieving a compactness of apparatus.

In conventional electrophotographic recording apparatus such as printers, facsimiles, etc., it is known that a visual toner image is produced by the successive steps of (1) forming an electrostatic latent image corresponding to original image or information data, for instance, on a cylindrical image-bearing member, (2) magnetically attracting a magnetic developer on a rotatable developing roll equipped with an inner permanent magnet and disposed opposing the image-bearing member, (3) delivering the magnetic developer, while forming a magnetic brush, to a developing zone where the electrostatic latent image on the image-bearing member is slidingly brushed with the magnetic brush. The developed image is then transferred to a recording sheet and fixed thereon by heating.

After transferring the toner image to the recording sheet, a small amount of the toner is likely to remain on a photosensitive drum as an image-bearing member in such an electrophotographic recording apparatus. Thus, a cleaning device is generally provided to remove the residual toner from the image-bearing member. To this end, a space for installing the cleaning device must be provided in the vicinity of the image-bearing member, failing to achieve an intended compactness of the electrophotographic recording apparatus.

To accomplish the compactness of an electrophotographic recording apparatus, it has been proposed that the cleaning device be replaced by a so-called developing-cleaning unit having developing and cleaning functions to remove a residual toner from the image-bearing member (Japanese Patent Laid-Open No. 4-86878). In the electrophotographic recording apparatus equipped with such a developing-cleaning unit, a magnetic developer containing a toner and a spherical magnetic carrier is employed. However, in the case of using such a magnetic carrier of a spherical shape, a relatively small specific surface area of the magnetic carrier leads to a small contact area of the carrier and the toner, resulting in a small triboelectric charge of the toner and a low image density, thereby failing to obtain a clear toner image.

Further, proposals have been made to form a fine toner image by reducing a size of the magnetic carrier. By using the magnetic carrier having a reduced size, a toner image with a high resolution and a high quality can be obtained due to the formation of a thin developer layer. However, it is difficult to retain the magnetic carrier with a reduced size be well magnetically on the developing means, because the magnetic carrier is likely to scatter, thereby causing problems such as the contamination of the developing means and nearby elements, deterioration in a quality of the toner image, etc.

Furthermore, when one developing cycle is performed by one revolution of the image-bearing member in the electrophotographic recording apparatus equipped with the developing-cleaning unit having the developing and recovering functions, the toner remaining on the image-bearing member after a transferring step cannot completely be removed by the developing-cleaning unit, so that the residual toner will attach to the image-bearing member in an image-forming region. If the residual toner is not completely recovered, the resultant toner image on the recording sheet suffers from poor quality. To eliminate such a problem, there has been proposed a system in which one developing cycle is performed by two revolutions of the image-bearing member, achieving the complete recovery of the residual toner. However, when such a system is employed, an image-forming rate is low, failing to meet a recent demand for a rapid visualization of information.

OBJECT AND SUMMARY OF THE INVENTION

Accordingly, an object of the present invention is to provide an improved carrier for a developer for use in an electrophotographic recording apparatus, which is capable of providing a toner image with a high density and a high quality, and achieving a complete recovery of a residual toner, compactness of the apparatus, etc.

Another object of the present invention is to provide an improved method of electrophotographically producing a visual toner image by using the above carrier.

As a result of intense investigation, the inventors have found that when non-spherical iron particles covered with resin layers are employed as a carrier for a developer, a toner image having improved density and quality is obtained with complete recovery of a residual toner and compactness of the apparatus. The present invention has been completed based on this finding.

Thus, the present invention provides a carrier for a developer comprising non-spherical iron particles covered with resin layers and having an average size of 10–50 μm.

Further, the present invention provides a method of electrophotographically producing a visual toner image, comprising the steps of (a) forming an electrostatic latent image on an image-bearing member; (b) developing the electrostatic latent image with a magnetic brush of a developer including a toner and a carrier brought into sliding contact with the image-bearing member to form a toner image, the carrier being composed of iron particles having non-spherical shapes and an average size of 10–50 μm and a resin layer formed on a surface of each of the iron particles; and (c) transferring the toner image to a recording sheet, wherein the toner remaining on the image-bearing member after the above transferring step (c) is removed in the developing step (b).

DETAILED DESCRIPTION OF THE INVENTION

Figure 1:
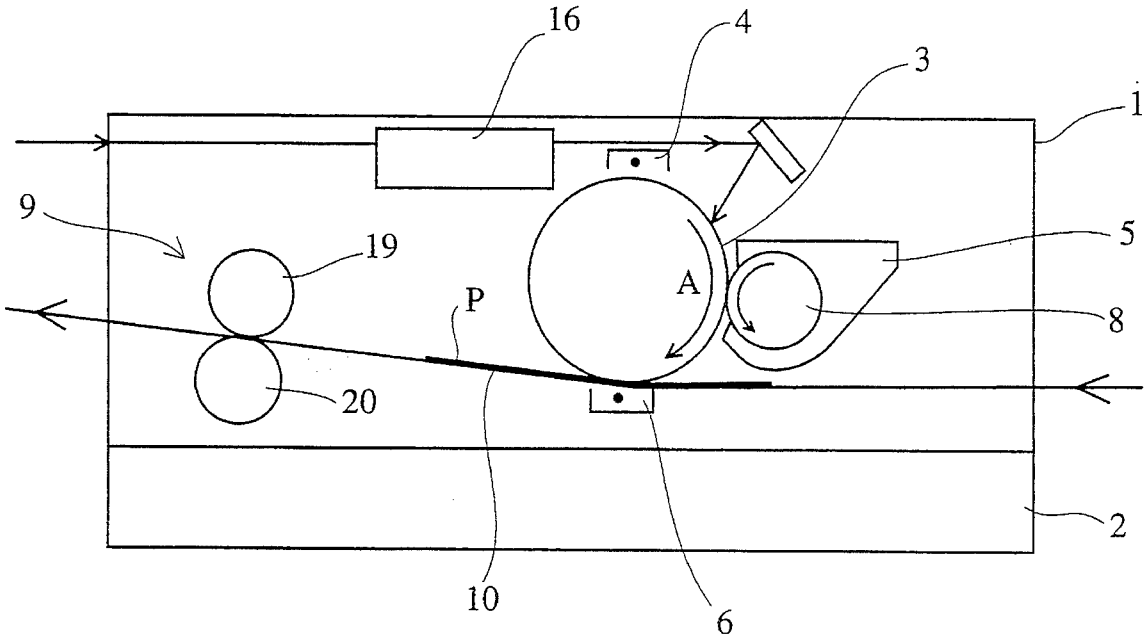
FIG. 1 is a schematic sectional view showing one example of an electrophotographic recording apparatus for accomplishing one embodiment of the present invention.

The present invention will be described in detail below.

A carrier of the present invention is one component of a developer. The developer containing such a carrier and a toner is used in an electrophotographic recording apparatus such as printers, facsimile, etc. to form a visual toner image on a recording medium such as paper sheets.

The carrier of the present invention is composed of iron particles having non-spherical shapes and an average size of 10 μm to 50 μm, and resin layers covering outer surfaces of the iron particles. When the average particle size of the iron particles is too small, so-called scattering of the carrier takes place, leading to poor quality of a toner image due to adhesion of the scattered carrier to a developing means, an image-bearing member, and nearby elements, etc. On the other hand, when the average particle size of the iron particles is too large, the resultant toner image is likely to be rough. Accordingly, the average particle size of the iron particles is in the range of 10–50 μm. Further, iron particles having particle sizes of less than 10 μm are preferably in the proportion of 0.01–60 weight % based on a total amount of the carrier.

The iron particles used as a constituent of the carrier may be pulverized iron particles or reduced iron particles. The suitable iron particles are of non-spherical shapes such as a polyhedral shape, a flaky shape, irregular shapes, etc. to increase specific surface areas thereof.

The resin layers are formed on the outer surfaces of the iron particles. Suitable materials for the resin layers include homopolymers or copolymers of styrenes such as parachlorostyrene, methylstyrene, etc.; vinyl halides such as vinyl chloride, vinyl bromide, vinyl fluoride, etc.; vinyl esters such as vinyl acetate, vinyl propionate, vinyl benzoate, etc.; aliphatic monocarboxylates such as methyl acrylate, ethyl acrylate, butyl acrylate, isobutyl acrylate, dodecyl acrylate, n-octyl acrylate, 3-chloroethyl acrylate, phenyl acrylate, methyl α-chloroacrylate, butyl methacrylate, etc.; acrylonitrile, methacrylonitrile, acrylamide; vinyl ethers such as vinyl methyl ether, vinyl isobutyl ether, vinyl ethyl ether, etc.; vinyl ketones such as vinyl ethyl ketone vinyl hexyl ketone, methyl isopropenyl ketone, etc.; and other resins such as epoxy resins, silicone resins, rosin-modified phenol-formaldehyde resins, cellulose resins, polyether resins, polyvinyl butyral resins, polyester resins, styrene-butadiene resins, polyurethane resins, polycarbonate resins, fluorocarbon resins such as tetrafluoroethylene, etc. These resin materials may be used alone or in combination. Among them, styrene-acrylic resins, silicone resins, epoxy resins, styrene-butadiene resins, cellulose resins, etc. are particularly preferable.

A thickness of the resin layer formed on each of the iron particles is in the range of 0.05 μm to 20 μm, preferably 0.1 μm to 10 μm.

The iron particles for the carrier of the present invention may be coated with resins according to the following method. First, the resin material for the resin layer is dissolved in an adequate solvent such as benzene, toluene, xylene, methyl ethyl ketone, tetrahydrofuran, chloroform, hexane, etc., to produce a resin solution or emulsion. The resin solution or emulsion is sprayed onto the surfaces of iron particles to form uniform resin layers thereon. To obtain the uniform resin layer, the iron particles are preferably maintained in a fluidized state desirably by employing a spray dryer or a fluidized bed. In the case of the resin solution, the solution is sprayed at about 200° C. or lower, preferably at about 100°–150° C., to rapidly remove a solvent from the resultant resin layer. On the other hand, in the case of the resin emulsion, the emulsion is sprayed at a temperature ranging from room temperature to 100° C. to adhere the fused resin to the surfaces of the iron particles.

Incidentally, before forming the resin layer, the iron particles may be treated with an adequate amount of at least one of known surface modifying agents such as a silane-coupling agent, titanate-coupling agent, zirconium aluminate-coupling agent, chromium-coupling agent, etc. to improve an adhering strength of the resin layer to the iron particles. Alternatively, the surface-modifying agents may be contained in the resin materials which are to be coated on the iron particles.

The carrier of the present invention may be mixed with a magnetic or non-magnetic toner to form a developer. In a case where the magnetic toner is mixed with the carrier, a toner concentration in the developer is in the range of 10–90 weight %, preferably 10–40 weight %. On the other hand, in a case where the non-magnetic toner is mixed with the carrier, the toner concentration is preferably in the range of 2–9 weight %.

According to the present invention, there is also provided a method of producing a visual toner image on a recording sheet, comprising the steps of (a) forming an electrostatic latent image on an image-bearing member; (b) developing the electrostatic latent image with a magnetic brush of a developer including a toner and a carrier brought into slide contact with the image-bearing member to form a toner image, the carrier being composed of iron particles having non-spherical shapes and an average size of 10–50 μm and resin layers formed on surfaces of the iron particles; and (c) transferring the toner image to the recording sheet, wherein the toner remaining on the image-bearing member after the above transferring step (c) is removed in the developing step (b).

In the method of the present invention, an exposure means such as a discharge lamp may be provided on a downstream side of a transferring means and on an upstream side of a charging means with respect to the rotation direction of the image-bearing member. The exposure means irradiates light beams to an entire width of the image-bearing member. Further, a discharge means for removing an electrostatic charge of the residual toner, such as a discharge roller, a discharge brush, etc. may be provided on an upstream side of a region where the magnetic brush comes into a, sliding contact with the image-bearing member. The discharge means may be made of a conductive material and can be brought into contact with the surface of the image-bearing member.

In the method of the present invention, the delivery of the developer to a developing region is not specifically restricted, but the developer is preferably delivered by a magnet roll including at least one rotatable sleeve. Alternatively, the delivery of the developer may be performed by a magnet roll including a rotatable sleeve and a rotatable permanent magnet member which are rotated in the same direction (refer to Japanese Patent Publication No. 57-12148) or in the opposite directions.

Next, the structure of an electrophotographic recording apparatus to which the present invention is applicable will be explained with reference to the attached drawings.

Referring to FIG. 1, there is schematically shown essential parts of the electrophotographic recording apparatus which can carry out one embodiment of the present invention. A reference numeral 1 denotes an image-forming unit which accommodates therein a plurality of components described hereinafter and is held in place on a control unit 2. A reference numeral 3 denotes a cylindrical image-bearing member (photosensitive drum) which is provided on an outer circumferential surface thereof with a photosensitive layer made of zinc oxide or an organic semiconductor. The image-beating member 3 is disposed inside the image-forming unit 1 so as to rotate in the direction indicated by an arrow A in FIG. 1. A charging unit 4, a developing-cleaning unit 5 and a transferring unit 6 are arranged in this order near the image-bearing member 3. A magnet roll 8 is disposed in the developing-cleaning unit 5 such that the magnet roll 8 is opposing the image-bearing member 3. The magnet roll 8 is composed of a permanent magnet member 21 and a sleeve 22 as mentioned in detail referring to FIG. 2 below.

A fixing unit 9 is disposed on a downstream side of the image-bearing member 3 along a delivering path 10 of a recording sheet P. The fixing unit 9 is constituted by a heating roller 19 and a pressure roller 20 which come into a pressed contact with each other under a line pressure of 0.5 kg/cm. The heating roller 19 and the pressure roller 20 may have an outer diameter of 20 mm. The heating roller 19 is composed of a core made of, for instance, aluminum, a heating element made of an electrically resistant material provided on an outer surface of the core, and a cover layer made of a mold-releasing material and having a thickness of 10 μm. On the other hand, the pressure roller 20 is composed of a core made of the same material as that of the core of the heating roller 19, and an outer layer made of, for instance, a silicone rubber.

In the operation of the electrophotographic recording apparatus thus constructed, with all units in the image-forming unit 1 energized, image or information data are first supplied from a laser scanner 16 and converted to the corresponding electrical signals. Next, an outer surface of the image-bearing member 3 is electrostatically uniformly charged by the charging unit 4. The charged outer surface of the image-bearing member 3 is irradiated with a laser beam in response to the electrical signals so that an electrostatic latent image corresponding to the original image or information data is formed thereon. The magnet roll 8 magnetically attracts a magnetic developer and delivers the developer to a developing region where the electrostatic latent image is developed by contact with the delivered developer, thereby forming a toner image. The developed toner image is then transferred to a recording sheet P delivered along the delivery path 10. Incidentally, a residual toner on the image-bearing member 3 after a transferring step is removed by the developing-cleaning unit 5 simultaneously with a developing step of the electrostatic latent image.

The recording sheet with the transferred toner image is transported along the delivery path 10 to the fixing unit 9. In the fixing unit 9, the recording sheet is allowed to pass between the heating roller 19 and the pressure roller 20 to heat the toner on the recording sheet by the heating roller 19, thereby melting a binder resin in the toner and fixing the toner onto the recording sheet P.

Figure 2:
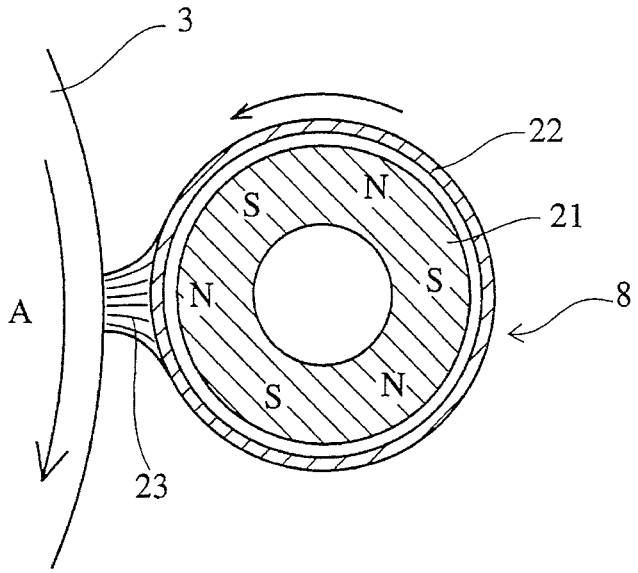
FIG. 2 is an enlarged sectional view of essential parts of a magnetic roll shown in FIG. 1.

Referring to FIG. 2, there is shown the magnet roll 8 composed of a cylindrical permanent magnet member 21 and a hollow cylindrical sleeve 22 disposed concentrically with the permanent magnet member 21. The permanent magnet member 21 may be made of, for instance, a sintered magnetic material such as a hard ferrite or a mixture of a ferromagnetic material and a binder resin, and shaped into an integral cylindrical body. The sleeve 22 may be made of non-magnetic materials such as aluminum alloys, stainless steel, etc.

The permanent magnet member 21 is provided on its outer surface with a plurality of magnetic poles extending in the axial direction thereof, and secured to the developing-cleaning unit 5 such that a specific pole (for instance, an N pole) is opposed to the image-bearing member 3. The sleeve 22 is rotated, for instance, in the counterclockwise direction around the permanent magnet member 21 while attracting a magnetic developer (not shown) thereon and delivering it toward the image-bearing member 3. In the above embodiment, though only the sleeve 22 is rotated, the permanent magnet member 21 and the sleeve 22 may be rotated in the same direction or in the opposite directions as described hereinbefore.

In such a construction mentioned above, the magnetic developer attracted onto a surface of the sleeve 22 forms a magnetic brush 23 by an effect of the N pole in the developing region where the magnet roll 8 and the image-bearing member 3 are opposed to each other. The magnetic brush 23 thus formed is allowed to come into a sliding contact with a surface of the image-bearing member 3.

A gap between the image-bearing member 3 and the sleeve 22 (hereinafter referred to simply as "developing gap") is suitably not greater than 1.0 mm to ensure the contact of the magnetic brush 23 with the surface of the image-bearing member 3 and a recovery of a residual toner from the surface of the image-bearing member 3. On the other hand, the developing gap should be not less than 0.2 mm to achieve a soft contact of the magnetic brush 23 with the surface of the image-bearing member 3. The preferred developing gap is from 0.3 mm to 0.6 mm. A doctor gap between a doctor blade (not shown) and the sleeve 22 may be determined properly depending upon the developing gap.

As mentioned above, the toner remaining after the transferring step is removed and recovered by the magnetic brush 23 simultaneously with the development of the electrostatic latent image. The removal and recovery of the toner is performed by bringing the magnetic brush into a sliding contact with the image-bearing member 3.

Figure 3A:
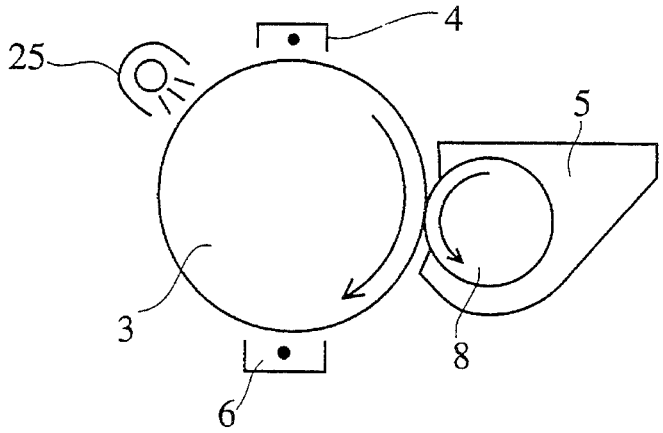
FIGS. 3(*a*) to 3(*c*) are schematic sectional views showing image-forming procedures according to other embodiments of the present invention, in which an exposure unit (FIG. 3(*a*)), a discharge roller (FIG. 3(*b*)) and a discharge brush (FIG. 3(*c*)) are respectively provided to dissipate or reduce a charge of a residual toner.
Figure 3B:
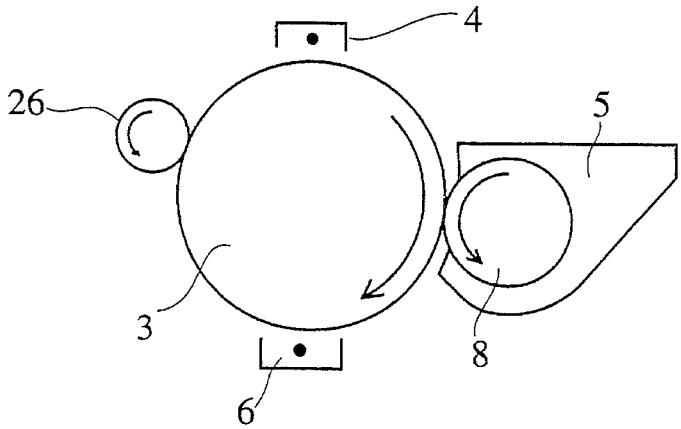
Figure 3C:
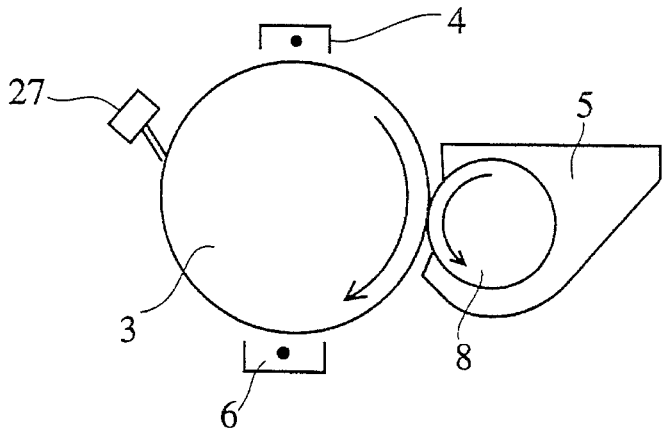

In FIGS. 3(*a*) to 3(*c*), there are shown essential parts of an electrophotographic recording apparatus according to further embodiments of the present invention in which an discharge lamp 25 (FIG. 3(*a*)), a discharge roll 26 (FIG. 3(*b*)) and a discharge brush 27 (FIG. 3(*c*)) are arranged near the image-forming member 3 between the transferring unit 6 and the charging unit 4.

In FIG. 3(*a*), the discharge lamp 25 is provided for irradiating a light onto an entire width of the image-forming member 3 after transferring step. An exposure to light irradiation causes a dissipation or reduction of the charge of the toner remaining on the surface of the image-bearing member 3, thereby aiding developing and cleaning functions of the developing-cleaning unit 5.

As seen in FIGS. 3(*b*) and 3(*c*), the discharge roll 26 and the discharge brush 27, both of which may be made of a conductive material, are respectively arranged in contact with the surface of the image-bearing member 3. A bias voltage ranging from 0 V to 400 V is applied to the discharge roll 26 (FIG. 3(*b*)) and the discharge brush 27 (FIG. 3(*c*)). By using these elements, the charged voltage of the magnetic toner remaining on the surface of the image-bearing n-member 3 is well dissipated, and the residual magnetic toner is mechanically removed by sliding contact of the image-bearing member 3 and the discharge roll 26 or the discharge brush 27.

As mentioned above, according to the present invention, the magnetic brush formed in the developing and cleaning region can effectively remove and recover the residual toner from the image-bearing member, thereby providing the resultant toner image with a high density and a high quality without any separate cleaning means. As a matter of course, the present invention is applicable to an image-forming method in which cleaning of the image-bearing member is carried out by a separate cleaning means before the formation of the electrostatic latent image.

The present invention will be described in more detail by way of Examples without intention of restricting the scope of the present invention which is defined by the claims attached hereto.

Examples 1–3 and Comparative Example 1

Preparation of Carrier

Scraps of mild steel were subjected to successive treatments including a primary pulverization, an oil quenching, a mineral dressing, etc. to prepare primary particles. The primary particles were further pulverized and then classified into four kinds of iron particles having average sizes of 10 μm (Example 1), 30 μm (Example 2), 50 μm (Example 3) and 70 μm (Comparative Example 1), respectively. All of these iron particles were of non-spherical shapes such as a polyhedral shape, a flaky shape, etc. and had a specific volume resistance of $4\times10^4$ Ω.cm. Each kind of the iron particles was placed in a fluidized bed to coat them with an emulsion of a styrene-acrylic resin to produce four kinds of the resin-coated carriers each having a specific volume resistance of $6\times10^8$ Ω.cm.

Preparation of Toner

A magnetic toner of a charge type was prepared from the following ingredients:

(1) Styrene-n-butylmethacrylate ($Mw=21\times10^4$, $Mn=1.6\times10^4$): 50 parts by weight, (2) Magnetite (EPT500 manufactured by Toda Kogyo K.K.): 45 parts by weight, (3) Polypropylene (BISKOL550P manufactured by Sanyo Kasei Kogyo K.K.): 3 parts by weight, and (4) Charge-controlling agent (Bontron E-81 manufactured by Orient Chemical Industries K.K.): 2 part by weight.

These ingredients were mixed by a kneader equipped with a heating roller. After cooling and solidifying, the mixture was pulverized and classified to obtain a magnetic toner having an average size of 9 μm. The magnetic toner thus obtained had a specific volume resistance of $3\times10^{14}$ Ω.cm.

Incidentally, the above specific volume resistance of the carrier and the magnetic toner was determined from electric resistance measured on appropriate amounts (several tens of mg) of the carrier and the magnetic toner charged into insulated dial-gauge type cylinders made of Teflon (trade name) and having an inner diameter of 3.05 mm (cross-sectional area: 0.073 $cm^2$) and exposed to an electric field of D.C. 200 V/cm (for the carrier) and D.C. 4000 V/cm (for the magnetic toner) under a load of 0.1 kgf, by using an insulation resistance tester (4329A type tester manufactured by Yokogawa-Hewlett-Packard, Ltd.).

In Example 1, the above magnetic toner was mixed with the resin-coated carrier of iron particles having an average size of 10 μm to prepare a developer having a toner concentration of 30 weight %. The developer was charged into a developing-cleaning unit 5 of an electrophotographic recording apparatus shown in FIG. 1.

The image-bearing member 3 was uniformly-charged at −550 V by a charging unit 4 while the image-bearing member 3 was rotated at a peripheral speed of 60 mm/second in a direction indicated by the arrow A in FIG. 1.

A magnet roll 8 in the developing-cleaning unit 5 was composed of a hollow cylindrical sleeve 22 made of stainless steel (SUS304) and having an outer diameter of 20 mm, and a permanent magnet member 21 disposed within the sleeve 22 and having six magnetic poles on the surface as shown in FIG. 2. A surface magnetic flux density on the sleeve 22 was 700 G and a rotation speed of the sleeve was adjusted to 150 rpm. Bias voltage of-400 V was applied to the sleeve 22.

A doctor gap and a developing gap were adjusted to 0.35 mm and 0.3 mm, respectively. A transferred toner image was fixed onto a recording sheet at a line pressure of 1 kgf/cm and at a temperature of 180° C.

Under the above conditions, a toner image was formed with the above developer and tested with respect to image density, resolution and adhesion of carrier to the image-bearing member 3. The results are shown in Table 1.

In Examples 2 and 3 using two kinds of the resincoated carriers composed of iron particles having average sizes of 30 μm (Example 2) and 50 μm (Example 3), respectively, toner image was formed and tested in the same manner as in Example 1. The results are also shown in Table 1.

In Comparative Example 1using the resin-coated carrier composed of iron particles having an average size of 70 μm, the image-forming procedures were conducted in the same manner as in Example 1. The results are also shown in Table 1.

Incidentally, in Examples 1–3 in which the carriers composed of iron particles having average particle sizes of 10–50 μm were employed, the carrier composed of iron particles having particle sizes of less than 10 μm was contained in the proportion of 51.3 weight % (Example 1), 20.2 weight % (Example 2) and 1.4 weight % (Example 3) based on a total amount of the carrier. On the other hand, in Comparative Example 1, the proportion of the carrier composed of iron particles having particle sizes of less than 10 μm was 0.004 weight % based on a total amount of the carrier used.

Comparative Example 2

Iron particles of a spherical shape were used for a carrier. The iron particles were subjected to successive treatments including a pulverization, a denitrogenation, a surface oxidization, a reduction and a classification to obtain the carrier having an average size of 30 μm without coating any resin layer. The uncoated carrier had a specific volume resistance of $8\times10^7$ Ω.cm. The carrier was mixed with the same magnetic toner as used in Example 1 to prepare a developer. The developer was then charged into the developing-cleaning unit 5 of the image-forming unit 1 to conduct an image-forming process in the same manner as in Example 1. The results are also shown in Table 1.

TABLE 1

| No. | Average Size of Iron Particles (μm) | Image Density | Resolution(1) | Adhesion of Carrier(2) |
|---|---|---|---|---|
| Ex. 1 | 10 | 1.3 | 10 | ○ |
| Ex. 2 | 30 | 1.4 | 10 | ◎ |
| Ex. 3 | 50 | 1.4 | 8 | ◎ |

TABLE 1-continued

| No. | Average Size of Iron Particles (μm) | Image Density | Resolution[1] | Adhesion of Carrier[2] |
|---|---|---|---|---|
| Com. Ex. 1 | 70 | 1.2 | 6 | ⊙ |
| Com. Ex. 2 | 30 | 1.2 | 8 | x |

Note: [1]Expressed by the number of discernible lines per one millimeter.
[2]⊙: Excellent, o: Good, and x: Poor.

As is apparently noted from Table 1, in the case of the carrier composed of iron particles having an average size of 70 μm in Comparative Example 1, the density and the resolution of the toner image were insufficient though no adhesion of the carrier to the developing-cleaning unit and nearby elements took place. Further, in Comparative Example 2, the developer had a low triboelectric charge of the toner, and a low density of the toner image and an undesirable adhesion of the carrier to the recording sheet were generated. On the other hand, in the case of the developers of Examples 1–3, an increased triboelectric charge of the toner and the improved density and resolution of the toner image were obtained due to the use of the carrier which was of non-spherical shapes and covered with the resin layer.

As mentioned above, according to the present invention, since a carrier having a non-spherical shape and a small size is employed, the toner image having a high quality is obtained without any problems such as scattering of the carrier which would lead to the contamination of a developing unit and nearby elements in addition to poor quality of the resultant toner image. Further, a residual toner was effectively removed and recovered by a developing-cleaning unit. Both developing and cleaning functions can be performed by the developing-cleaning unit without providing a separate cleaning unit.

What is claimed is:

1. A method of electrophotographically forming a visual image on a recording sheet, comprising the steps of:

(a) forming an electrostatic latent image on an image-bearing member;

(b) developing said electrostatic latent image by contacting said image bearing member with a magnetic brush of a developer to form a toner image, said developer including a toner and a carrier, whereby said carrier is composed of iron particles having non-spherical shapes, an average size of 10–50 μm, and particle sizes of less than 10 μm in proportion of 0.01–60 weight % based on a total amount of said carrier, and wherein said carrier also includes a resin layer formed on a surface of each of said iron particles; and (c) transferring said toner image to a recording sheet, wherein any residual toner remaining on said image-bearing member after the above transferring step (c) is removed in the developing step (b).

2. The method according to claim 1, also including a step of irradiating a light onto said image-bearing member on an upstream side of a region where said electrostatic latent image is developed and on a downstream side of a region where said toner image is transferred to said recording sheet.

3. The method according to claim 2, wherein said irradiating step includes irradiating said image-bearing member with a discharge lamp.

4. The method of according to claim 1, also including a step of removing said residual toner with discharge means made of a conductive material provided on an upstream side of a region where said magnetic brush is brought into contact with said image-bearing member.

5. The method of claim 1, also including a step of removing said residual toner with a discharge roller.

6. The method according to claim 1, also including a step of removing said residual toner with a discharge brush.

7. A carrier for a developer for use in an electrophotographic recording apparatus, comprising iron particles having non-spherical shapes and an average size of 10– 50 μm, and a resin layer formed on surfaces of said iron particles, said iron particles having particle sizes of less than 10 μm being in the proportion of 0.01–60 weight % based on a total amount of the carrier.

8. The carrier according to claim 7, wherein said resin layer is made of a material selected from the group consisting of a styrene-acrylic resin, a silicone resin, an epoxy resin, a styrene-butadiene resin and a cellulose resin.

* * * * *